US008673531B2

(12) United States Patent
Inaba et al.

(10) Patent No.: US 8,673,531 B2
(45) Date of Patent: Mar. 18, 2014

(54) LIQUID DEVELOPER, PROCESS CARTRIDGE, IMAGE FORMING APPARATUS, AND IMAGE FORMING METHOD

(75) Inventors: Yoshihiro Inaba, Kanagawa (JP); Akira Imai, Kanagawa (JP); Daisuke Yoshino, Kanagawa (JP); Takako Kobayashi, Kanagawa (JP); Koji Horiba, Kanagawa (JP); Ryosaku Igarashi, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 85 days.

(21) Appl. No.: 13/149,098

(22) Filed: May 31, 2011

(65) Prior Publication Data

US 2012/0141933 A1 Jun. 7, 2012

(30) Foreign Application Priority Data

Dec. 7, 2010 (JP) ..... 2010-272941

(51) Int. Cl.
*G03G 9/00* (2006.01)

(52) U.S. Cl.
USPC ..... 430/114; 430/112

(58) Field of Classification Search
USPC ..... 430/112, 113, 114, 115, 116
See application file for complete search history.

(56) References Cited

U.S. PATENT DOCUMENTS

| | | | | |
|---|---|---|---|---|
| 4,181,620 | A * | 1/1980 | Tsubuko | 430/114 |
| 4,473,629 | A | 9/1984 | Herrmann et al. | |
| 4,957,844 | A * | 9/1990 | Page | 430/115 |
| 5,106,717 | A * | 4/1992 | Houle et al. | 430/114 |
| 5,843,613 | A * | 12/1998 | Fujiwara et al. | 430/114 |
| 6,190,816 | B1 | 2/2001 | Takehara et al. | |
| 7,008,744 | B2 * | 3/2006 | Horie et al. | 430/114 |
| 7,405,027 | B2 | 7/2008 | Chou et al. | |
| 2002/0197552 | A1 * | 12/2002 | Baker et al. | 430/114 |
| 2004/0006158 | A1 * | 1/2004 | Horie et al. | 523/160 |
| 2008/0248413 | A1 | 10/2008 | Ishii et al. | |
| 2012/0141933 | A1 | 6/2012 | Inaba et al. | |
| 2013/0078568 | A1 | 3/2013 | Inaba et al. | |

FOREIGN PATENT DOCUMENTS

| | | |
|---|---|---|
| EP | 0 390 105 A2 | 10/1990 |
| EP | 0 406 518 A1 | 1/1991 |
| JP | A-58-59458 | 4/1983 |
| JP | A-58-59459 | 4/1983 |
| JP | A-58-59460 | 4/1983 |
| JP | A-3-296067 | 12/1991 |
| JP | A-7-84407 | 3/1995 |
| JP | A-7-219269 | 8/1995 |
| JP | A-8-123080 | 5/1996 |
| JP | A-11-184149 | 7/1999 |
| JP | A-2000-181141 | 6/2000 |

(Continued)

OTHER PUBLICATIONS

Mar. 21, 2012 Extended European Search Report issued in European Patent Application No. 11172798.8.

(Continued)

*Primary Examiner* — Stewart Fraser
(74) *Attorney, Agent, or Firm* — Oliff PLC

(57) ABSTRACT

The present invention provides a liquid developer including an insulating carrier liquid and toner particles containing a binder resin, the binder resin including a styrene-based thermoplastic elastomer and a styrene thermoplastic resin, and the toner particles being dispersed in the insulating carrier liquid.

8 Claims, 1 Drawing Sheet

(56) References Cited

FOREIGN PATENT DOCUMENTS

| | | |
|---|---|---|
| JP | A-2001-175031 | 6/2001 |
| JP | A-2002-123040 | 4/2002 |
| JP | A-2004-205843 | 7/2004 |
| JP | A-2007-79348 | 3/2007 |

OTHER PUBLICATIONS

U.S. Appl. No. 13/212,625, filed Aug. 18, 2011.
Apr. 16, 2013 Office Action issued in U.S. Appl. No. 13/212,625.

* cited by examiner

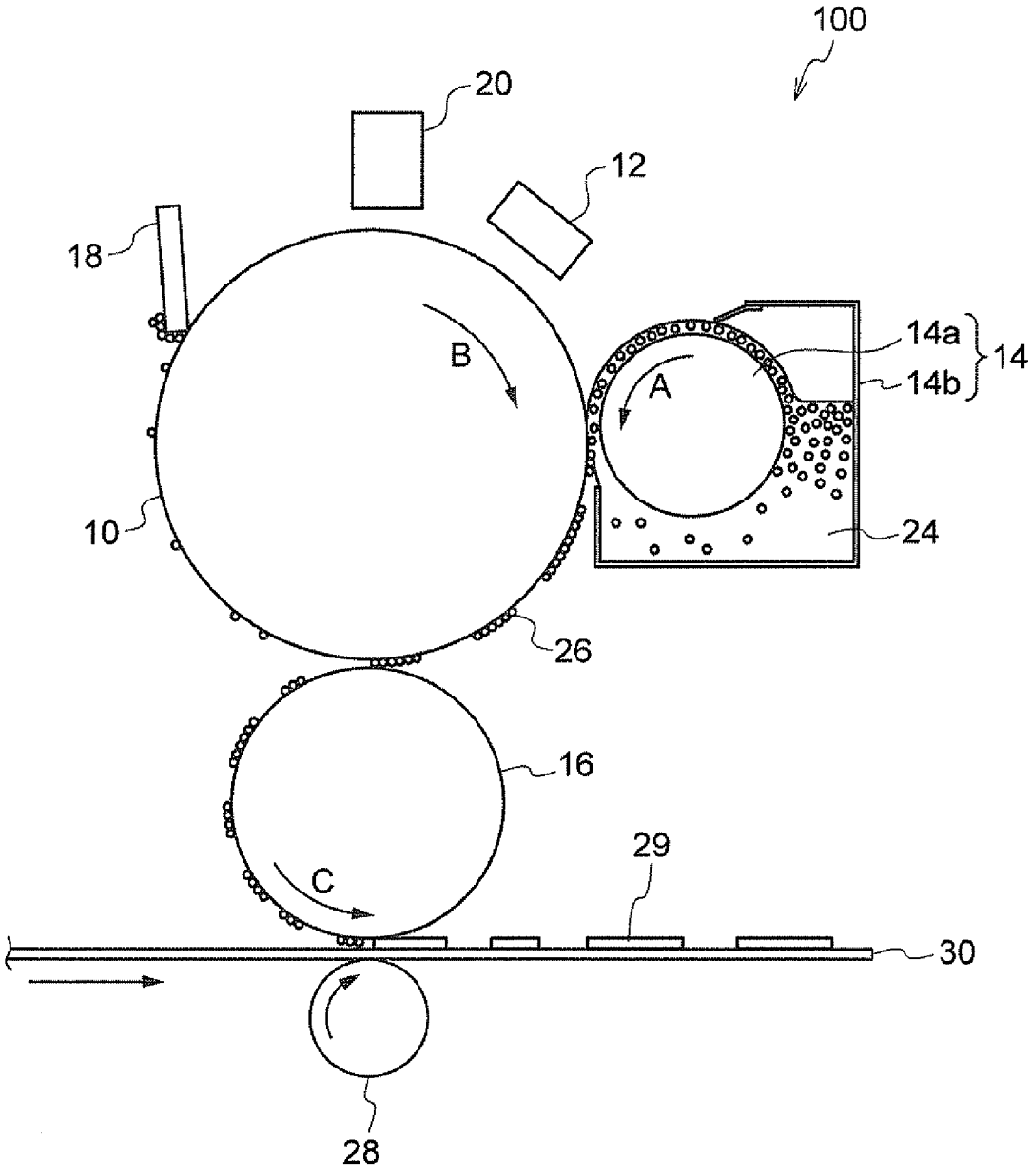
100
20
12
18
B
14a
14
14b
A
10
24
26
16
29
C
30
28

LIQUID DEVELOPER, PROCESS CARTRIDGE, IMAGE FORMING APPARATUS, AND IMAGE FORMING METHOD

CROSS-REFERENCE TO RELATED APPLICATION

This application is based on and claims priority under 35 USC 119 from Japanese Patent Application No. 2010-272941 filed on Dec. 7, 2010.

BACKGROUND

1. Technical Field

The present invention relates to a liquid developer, a process cartridge, an image forming apparatus, and an image forming method.

2. Related Art

With regard to toners used in a dry type developing system, for example, the following toners have been proposed.

A toner for developing an electrostatic charge image in which a styrene-butadiene block copolymer is used as a dispersant for wax added in a polyester based toner; a resin composition for toners which includes a styrene-acryl resin, a block copolymer of styrene and olefin, and wax; a toner for developing an electrostatic charge image including a styrene-acryl resin whose molecular weight lies within a specific range and a block copolymer of styrene and olefin; a resin composition for toners which includes a styrene-acryl resin having a weight average molecular weight (Mw) of from 10,000 to 150,000 and a block copolymer of styrene and olefin; and a toner including a thermoplastic elastomer as a binder resin have been proposed.

On the other hand, liquid developers are developers prepared by dispersing toner particles in an insulating carrier liquid. A type of liquid developers including a volatile carrier liquid containing therein dispersed toner particles including a thermoplastic resin, and another type of liquid developers including a low-volatility carrier liquid containing therein dispersed toner particles including a thermoplastic resin are known.

SUMMARY

According to an aspect of the invention, a liquid developer including an insulating carrier liquid and toner particles containing a binder resin, the binder resin including a styrene-based thermoplastic elastomer and a styrene thermoplastic resin, and the toner particles being dispersed in the insulating carrier liquid, is provided.

BRIEF DESCRIPTION OF THE DRAWINGS

Exemplary embodiments of the present invention will be described in detail based on the following drawings, wherein:

FIG. 1 is a schematic configuration diagram illustrating an example of an image forming apparatus according to an exemplary embodiment of the present invention.

DETAILED DESCRIPTION

Exemplary embodiments based on the present invention include the following items <1> to <10>. However, the present invention is not limited thereto.

<1> A liquid developer including: an insulating carrier liquid; and toner particles containing a binder resin, the binder resin including a styrene-based thermoplastic elastomer and a styrene thermoplastic resin, and the toner particles being dispersed in the insulating carrier liquid.

<2> The liquid developer according to the item <1>, wherein a content of the styrene-based thermoplastic elastomer is approximately 5% by weight or more with respect to a total amount of the binder resin in the toner particle.

<3> The liquid developer according to the item <1> or the item <2>, wherein a liquid absorptivity value of the styrene-based thermoplastic elastomer at a temperature of 25° C. is approximately 200% by weight or less, the liquid being the insulating carrier liquid.

<4> The liquid developer according to any one of the items <1> to <3>, wherein the styrene-based thermoplastic elastomer includes a block copolymer of styrene and olefin or a random copolymer of styrene and olefin.

<5> The liquid developer according to any one of the items <1> to <4>, wherein the styrene thermoplastic resin includes a polymer of a styrene-based monomer or a vinyl-based copolymer which contains the styrene based monomer and a (meth)acrylate as a structural unit.

<6> The liquid developer according to any one of the items <1> to <5>, wherein the insulating carrier liquid includes paraffin oil as a main component.

<7> The liquid developer according to any one of the items <1> to <6>, further including pigment particles.

<8> A process cartridge including a developing unit that stores the liquid developer according to any one of the items <1> to <7>, and develops an electrostatic latent image formed on a surface of an electrostatic latent image holding member as a toner image by the liquid developer, the process cartridge being attachable to and detachable from an image forming apparatus.

<9> An image forming apparatus including: an electrostatic latent image holding member; a charging unit that charges a surface of the electrostatic latent image holding member; an electrostatic latent image forming unit that forms an electrostatic latent image on the surface of the electrostatic latent image holding member; a developing unit that stores the liquid developer according to any one of the items <1> to <7>, and develops the electrostatic latent image formed on the surface of the electrostatic latent image holding member as a toner image by the liquid developer; a transfer unit that transfers the toner image onto a recording medium; and a fixing unit that fixes the toner image onto the recording medium.

<10> An image forming method including: charging a surface of an electrostatic latent image holding member; forming an electrostatic latent image on the surface of the electrostatic latent image holding member; developing the electrostatic latent image formed on the surface of the electrostatic latent image holding member as a toner image by using the liquid developer according to any one of the items <1> to <7>; transferring the toner image onto a recording medium; and fixing the toner image onto the recording medium.

Hereinafter, exemplary embodiments of the present invention will be described in detail by arbitrarily referring an attached drawings if necessary.

Liquid Developer

The liquid developer according to an exemplary embodiment of the invention contains toner particles containing a binder resin including a styrene based thermoplastic elastomer and a styrene thermoplastic resin, and an insulating carrier liquid for dispersing the toner particles. When an image is formed on a recording medium such as paper by using the liquid developer of the exemplary embodiment of the invention, an image having excellent durability with respect to folding, namely, an image in which fall-off of the toner at the folded portion is suppressed when the recording medium is folded may be obtained. The reason why an image having excellent durability with respect to folding can be obtained by using the liquid developer according to the exemplary embodiment of the invention is considered as follows.

For example, when a liquid developer is prepared by dispersing toner particles for dry type development using, as a binder resin, a styrene acryl resin or polyester in a carrier liquid, and an image is formed on a recording medium using this liquid developer, a part of the toner in the image at the folded portion falls off when the recording medium is folded and thus, it is difficult to obtain a good durability with respect to folding. The cause for this is thought as follows. In the liquid developer, since the toner particles are dispersed in a carrier liquid, there exist interactions between the toner particles and the carrier liquid. In the toner particles for dry type development, difference in SP value (solubility parameter) between the toner particle and the carrier liquid is great and thus, inhibition of fusion among the toner particles or the like may be caused at the time of fixation, due to the remaining carrier liquid between the toner particles.

On the contrary, in the liquid developer of the exemplary embodiment of the invention, by using toner particles containing a binder resin including a styrene based thermoplastic elastomer and a styrene based thermoplastic resin, it is thought that conformability between the toner particle and the carrier liquid is enhanced and flexibility is imparted, resulting in improvement in durability with respect to folding.

It should be noted that, according to the exemplary embodiments of the present invention, a liquid developer which exhibits excellent anti-scratching property and excellent low-temperature fixing property, as well as excellent durability with respect to folding may be provided.

Hereinafter, constituent components of the liquid developer according to the exemplary embodiment of the invention are described in detail.

Toner Particles

The toner particles dispersed in the liquid developer according to the exemplary embodiment of the invention is configured to include a binder resin including a styrene based thermoplastic elastomer and a styrene based thermoplastic resin. The styrene based thermoplastic elastomer mainly enhances the flexibility of the binder resin that forms the toner particles and contributes to the improvement in the durability with respect to folding, and the styrene based thermoplastic resin mainly contributes to the improvement in the anti-scratching property.

Styrene Based Thermoplastic Resin

The styrene based thermoplastic resin in the exemplary embodiment of the invention includes a polymer of a styrene based monomer, a vinyl-based copolymer which contains the styrene based monomer and a (meth)acrylate as a structural unit, and the like. Here, the term "(meth)acrylic" means any one or both of "acrylic" and "methacrylic".

Examples of the styrene based monomer include styrene, o-methylstyrene, m-methylstyrene, p-methylstyrene, α-methylstyrene, p-ethylstyrene, 2,4-dimethylstyrene, p-n-butylstyrene, p-tert-butylstyrene, p-n-hexylstyrene, p-n-octylstyrene, p-n-dodecylstyrene, p-methoxystyrene, p-phenylstyrene, p-chlorostyrene, 3,4-dichlorostyrene and the like.

Examples of the (meth)acrylate monomer include alkyl (meth)acrylates such as methyl (meth)acrylate, ethyl (meth) acrylate, propyl (meth)acrylate, n-butyl (meth)acrylate, isobutyl (meth)acrylate, n-octyl (meth)acrylate, dodecyl (meth)acrylate, 2-ethylhexyl (meth)acrylate, and stearyl (meth)acrylate; 2-chloroethyl (meth)acrylate; phenyl (meth) acrylate; methyl α-chloroacrylate, 2-hydroxyethyl (meth) acrylate; 2-hydroxypropyl (meth)acrylate; 2-hydroxybutyl (meth)acrylate; glycidyl (meth)acrylate; dimethylaminoethyl (meth)acrylate; diethylaminoethyl (meth)acrylate; bisglycidyl (meth)acrylate; polyethylene glycol di(meth)acrylate; (meth)acryloyloxyethyl phosphate; and the like. Among the above, methyl (meth)acrylate, ethyl (meth)acrylate, propyl (meth)acrylate, n-butyl (meth)acrylate, 2-ethylhexyl acrylate or the like may be preferably used.

As the other monomer other than the styrene based monomer and the (meth)acrylate monomer, acrylic acid or α-alkyl or β-alkyl derivatives of the acrylic acid such as acrylic acid, methacrylic acid, α-ethylacrylic acid, crotonic acid, or the like; unsaturated dicarboxylic acids or mono- or di-esters thereof such as fumaric acid, maleic acid, citraconic acid, itaconic acid, or the like; mono(meth)acryloyloxyethyl succinate; (meth)acrylonitrile; (meth)acrylamide; and the like may be used.

As the monomer, a cross linkable monomer which contains two or more carbon-carbon double bonds may be used, if necessary. Examples of the cross linkable monomer include aromatic compound having two vinyl groups such as divinylbenzene, divinylnaphthalene, and the like; di(meth)acrylates such as ethylene glycol di(meth)acrylate, 1,3-butylene glycol di(meth)acrylate, 1,4-butandiol di(meth)acrylate, 1,5-pentanediol di(meth)acrylate, 1,6-hexanediol di(meth)acrylate, neopentyl glycol di(meth)acrylate, diethylene glycol di(meth)acrylate, triethylene glycol di(meth)acrylate, tetraethylene glycol di(meth)acrylate, polyoxyethylene(2)-2,2-bis(4-hydroxyphenyl)propane di(meth)acrylate, polyoxyethylene(4)-2,2-bis(4-hydroxyphenyl)propane di(meth)acrylate and the like; polyfunctional cross linkable monomers such as pentaerythritol tri(meth)acrylate, trimethylolethane tri(meth) acrylate, trimethylolpropane tri(meth)acrylate, tetramethylolmethane tetra(meth)acrylate, and the like; and the like.

A weight average molecular weight (Mw) of the vinyl-based polymer is preferably in a range of 150,000 to 500,000. When the weight average molecular weight (Mw) of the vinyl-based polymer is 150,000 or more, the anti-scratching property is certainly improved. When the weight average molecular weight (Mw) is 500,000 or less, the melt viscosity is suppressed low, and smoothness of the fixed face may be obtained, whereby a desired coloring property may be realized.

Further, the molecular weight distribution (Mw/Mn) of the vinyl-based polymer is preferably from 2 to 20. When the molecular weight distribution (Mw/Mn) of the vinyl-based polymer is 2 or more, the viscosity in the high temperature region becomes low, and inhibition of offset resistance may be suppressed. When the molecular weight distribution (Mw/Mn) is 20 or less, deterioration in fixing property may be suppressed.

In addition, the vinyl-based polymer may have plural peaks or a shoulder portion in its molecular weight distribution curve measured by gel permeation chromatography (GPC).

The content ratio of the styrene based thermoplastic resin in the toner particle is preferably from 50% by weight to 95% by weight, and more preferably from 60% by weight to 90% by weight, with respect to the whole binder resin, from the viewpoint of grindability.

Styrene Based Thermoplastic Elastomer

Examples of the styrene based thermoplastic elastomer incorporated in the toner particle of the exemplary embodiment of the invention include a block copolymer of styrene and olefin, and a random copolymer of styrene and olefin. The styrene based thermoplastic elastomer is a material having a characteristic of rubber at an ordinary temperature but becomes soft at a high temperature like thermoplastic plastics.

Specific examples of the styrene based thermoplastic elastomer include polystyrene-polybutadiene-polystyrene, polystyrene-polybutadiene/butylene-polystyrene, polystyrene-polyethylene/butylene-polystyrene, polystyrene-polyisoprene-polystyrene, polystyrene-hydrogenated polybutadiene-polystyrene, polystyrene-hydrogenated polyisoprene-polystyrene, polystyrene-hydrogenated poly(isoprene/butadiene)-polystyrene. In a styrene-butadiene block copolymer, double bonds remain in the form of bonding of a 1-4 body, or a 1-2 body; and a hydrogenated compound thereof may be also used. Further, a block copolymer having a polar group introduced into the soft segment portion sandwiched between polystyrenes may also be used. Note that, in the above examples of the copolymer, the front and the rare parts divided by the symbol "–" mean that these parts constitute a block copolymer, and the front and the rare parts divided by the symbol "/" mean that these parts may form a random copolymer or a block copolymer.

Examples of commercially available products include TUFTEC M1911, TUFTEC M1943, TUFTEC MP10, ASAPRENE T439, and TUFPRENE A (all trade names, manufactured by Asahi Kasei Corporation) and DYNARON 8630P (trade name, manufactured by Kuraray Co., Ltd.). Particularly, SOE-L611, SOE-L611X, and SOE-L605 (all trade names, manufactured by Asahi Kasei Corporation) in which the soft segment portion sandwiched between polystyrenes has been subjected to introduction of a polar group and hydrogenation are preferably used.

It is preferable that the content ratio of the styrene based thermoplastic elastomer is 5% by weight or more, or approximately 5% by weight or more, with respect to the whole binder resin in the toner particle. When the content ratio of the styrene based thermoplastic elastomer is within the above range, the durability with respect to folding and also the low-temperature fixing property are greatly improved. When the content ratio of the styrene based thermoplastic elastomer is 5% by weight or more, or approximately 5% by weight or more, with respect to the whole binder resin, the durability with respect to folding is certainly improved, as well as deterioration in offset resistance at a high temperature side is suppressed. The upper limit of the content ratio of the styrene based thermoplastic elastomer is not particularly defined. However, by taking the content ratio of the styrene based thermoplastic resin into consideration, the styrene based thermoplastic elastomer may be contained in an amount of 50% by weight or less with respect to the whole binder resin. When the content ratio of the styrene based thermoplastic resin is raised in order to impart grindability, the styrene based thermoplastic elastomer may be contained in an amount of 40% by weight or less with respect to the whole binder resin.

It is preferable that the liquid absorptivity value at a temperature of 25° C. of the styrene based thermoplastic elastomer with respect to the carrier liquid is 200% or less, or approximately 200% or less. In a case in which the carrier liquid contains a low-volatility oil having an extremely large molecular weight, when the liquid absorptivity value at a temperature of 25° C. of the styrene based thermoplastic elastomer with respect to the carrier liquid is 200% or less, or approximately 200% or less, lowering of the strength of fixed images is suppressed and the anti-scratching property may be improved.

From the viewpoint of storage stability, the liquid absorptivity value at a temperature of 25° C. of the styrene based thermoplastic elastomer with respect to the carrier liquid is more preferably from 0% to 150%, or from approximately 0% to approximately 150%, and particularly preferably from 5% to 100%, or from approximately 5% to approximately 100%.

The above liquid absorptivity value is expressed by a value determined as follows. 2 g of pellets of thermoplastic elastomer are introduced into a 200 mL beaker containing 100 mL of paraffin oil, and the beaker is left to stand in a 25° C. constant temperature device for 15 hours. Thereafter, the contents of the beaker are filtrated using a 200 mesh wire net. The separated pellets are placed between sheets of filter paper, to absorb the excess oil. Then, the amount of increase in weight is measured, and the liquid absorptivity value is calculated according to the following equation.

$$\text{Liquid absorptivity value}(\%)=(\text{Amount of increase in weight}/\text{Weight of dry pellet at the beginning of the measurement})\times 100$$

The toner particle in the exemplary embodiment of the invention may include, as necessary, other additives such as another binder resin, a colorant, wax, a charge controlling agent, silica powder, or a metal oxide, other than the styrene based thermoplastic elastomer and the styrene based thermoplastic resin. These additives may be internally added to the binder resin containing the styrene based thermoplastic elastomer and the styrene based thermoplastic resin through kneading or the like, or may be externally added through performing a mixing treatment or the like, after obtaining the toner as particles. Note that, generally, the toner particle contains a colorant; however, in the case of preparing a transparent toner, the toner particle may not contain a colorant.

Examples of the binder resin other than the styrene based thermoplastic elastomer and the styrene based thermoplastic resin, which is incorporated in the toner particle, include known binder resins. Specific examples thereof include polyester, polyethylene, polypropylene, polyurethane, an epoxy resin, a silicone resin, polyamide, and a modified rosin.

A known pigment or dye is used as the colorant. Specifically, the yellow, magenta, cyan, and black pigments described below may be used.

As a yellow pigment, a compound represented by a condensed azo compound, an isoindolinone compound, an anthraquinone compound, an azo metal complex compound, a methine compound, or an allylamide compound is used.

As a magenta pigment, a condensed azo compound, a diketopyrrolopyrrole compound, an anthraquinone compound, a quinacridone compound, a basic dye lake compound, a naphthol compound, a benzimidazolone compound, a thioindigo compound, or a perylene compound is used.

As a cyan pigment, a copper phthalocyanine compound or a derivative thereof, an anthraquinone compound, a basic dye lake compound, or the like is used.

As a black pigment, carbon black, aniline black, acetylene black, black iron oxide, or the like is used.

The wax is not particularly limited, and examples thereof include vegetable waxes such as carnauba wax, Japan tallow, and rice bran wax; animal waxes such as beeswax, insect wax, whale wax, and wool wax; mineral waxes such as montan wax and ozokerite; synthetic fatty acid solid ester waxes such as Fischer Tropsch wax (FT wax) which has ester in the side chain, special fatty acid ester, and polyhydric alcohol ester; synthetic waxes such as paraffin wax, polyethylene wax, polypropylene wax, polytetrafluoroethylene wax, polyamide wax, and silicone compounds. The waxes may be used alone, or in a combination of two or more of them.

The charge controlling agent is not particularly limited and conventionally known charge controlling agents may be used.

Examples of the charge controlling agent include positively charged type charge controlling agents such as a nigrosine dye, a fatty acid modified nigrosine dye, a carboxyl group-containing fatty acid modified nigrosine dye, a quaternary ammonium salt, an amine compound, an amide compound, an imide compound, and an organic metal compound; and negatively charged type charge controlling agents such as a metal complex of hydroxy carboxylic acid, a metal complex of an azo compound, a metal complex salt dye, and a salicylic acid derivative. The charge controlling agents may be used alone, or in a combination of two or more of them.

In embodiments, a metal oxide is not particularly limited. Examples of the metal oxide include a titanium oxide, an aluminum oxide, a magnesium oxide, a zinc oxide, a strontium titanate, a barium titanate, a magnesium titanate, a calcium titanate, and the like. The metal oxide may be used alone or in a combination of two kinds or more thereof.

—Method for Preparing Toner Particles—

The method for preparing the toner particles used in the exemplary embodiments of the invention is not particularly limited. For example, the toner particles may be obtained by finely pulverizing a toner, which has been produced by a preparation method of pulverized toner, drying in liquid of emulsification toner, or polymerized toner, in a carrier liquid.

For example, a pulverized toner can be obtained as follows. Namely, a binder resin containing a styrene based thermoplastic elastomer and a styrene based thermoplastic resin, a colorant and, as necessary, other additives are introduced into a mixing device such as a Henschel mixer, and are mixed. Then, the resulting mixture is melt-kneaded using a twin-screw extruder, a Banbury mixer, a roll mill, a kneader, or the like. Thereafter, the kneaded mixture is cooled using a drum flaker or the like, and roughly pulverized by using a grinding machine such as a hammer mill, and then finely pulverized by using a grinding machine such as a jet mill. Thereafter, the resultant is classified by using a air classifier or the like, to obtain a pulverized toner.

Further, a drying in liquid of emulsification toner can be obtained as follows. Namely, a binder resin containing a styrene based thermoplastic elastomer and a styrene based thermoplastic resin, a colorant and, as necessary, other additives are dissolved in a solvent such as ethyl acetate, and then the resulting liquid is emulsified/suspended in water containing a dispersion stabilizer such as calcium carbonate. After removing the solvent, the particles obtained by removing the dispersion stabilizer are filtrated and dried, to obtain a submerged emulsification dry toner.

Moreover, a polymerized toner can be obtained as follows. Namely, a composition including a polymerizable monomer which forms a binder resin, a colorant, a polymerization initiator (for example, benzoyl peroxide, lauloyl peroxide, isopropyl peroxycarbonate, cumene hydroperoxide, 2,4-dichlorobenzoyl peroxide, methyl ethyl ketone peroxide, or the like), other additives, and the like are added to an aqueous phase under stirring, to perform granulation. After the polymerization reaction is completed, the particles are filtrated and dried, to obtain a polymerized toner.

The blend proportion of the materials (the styrene based thermoplastic elastomer, the styrene based thermoplastic resin, the colorant, the other additives, and the like) for preparing the toner may be determined in consideration of the required durability with respect to folding, anti-scratching property, low-temperature fixing property, color, and the like. The obtained toner is finely pulverized in a carrier oil by using a known grinding device such as a ball mill, a bead mill, a high pressure wet grinding machine, or the like, whereby the toner particles for liquid developer of the exemplary embodiment of the invention may be obtained.

The volume average particle diameter D50v of the toner particles is preferably from 0.5 μm to 5.0 μm. When the volume average particle diameter D50v is within the above range, adhesion may be enhanced and developing property may be improved. Further, resolution of images may also be improved. The volume average particle diameter D50v of the toner particles is more preferably from 0.8 μm to 4.0 μm, and even more preferably from 1.0 μm to 3.0 μm.

The volume average particle diameter D50v, the number average particle size distribution index (GSDp), the volume average particle size distribution index (GSDv), and the like are measured using a laser diffraction/scattering particle size distribution measuring device, for example, LA 920 (trade name, manufactured by Horiba Ltd.). The particle size distribution is accumulated to draw cumulative distributions of the volume and the number from the smallest diameter for divided particle size ranges (channels). The particle diameters corresponding to 16% in the volume and number cumulative distributions are respectively defined as accumulated volume particle diameter D16v and accumulated number particle diameter D16p; the particle diameters corresponding to 50% in the volume and number cumulative distributions are respectively defined as volume average particle diameter D50v and number average particle diameter D50p; and the particle diameters corresponding to 84% in the volume and number cumulative distributions are respectively defined as accumulated volume particle diameter D84v and accumulated number particle diameter D84p. Further, using these values, the volume average particle size distribution index (GSDv) is calculated as $(D84v/D16v)^{1/2}$, and the number average particle size distribution index (GSDp) is calculated as $(D84p/D16p)^{1/2}$.

Carrier Liquid

The carrier liquid is an insulating liquid for dispersing the toner particles. There is no particular limitation on the carrier liquid, and examples thereof include fatty acid-based hydrocarbon solvents such as paraffin oil (as commercially available products, MORESCO WHITE MT-30P, MORESCO WHITE P40, and MORESCO WHITE P70 (all trade names, delivered from MATSUMURA OIL Co., Ltd.), ISOPAR L and ISOPAR M (all trade names, manufactured by Exxon Mobil Chemical Company), and the like are described); and hydrocarbon-based solvents such as naphthene-based oil (as commercially available products, EXXOL D80, EXXOL D110, and EXXOL D130 (all trade names, manufactured by Exxon Mobil Chemical Company), NAPHTHESOL L, NAPHTHESOL M, NAPHTHESOL H, NEW NAPHTHESOL 160, NEW NAPHTHESOL 200, NEW NAPHTHESOL 220, and NEW NAPHTHESOL MS-20P (all trade names, manufactured by Nippon Petrochemicals Co., Ltd.), and the like are described). An aromatic compound such as toluene may be added to these liquids.

One kind of the carrier liquids may be contained in the liquid developer of the exemplary embodiment of the invention, or two or more kinds of the carrier liquids may be contained in the liquid developer of the exemplary embodiment of the invention. In the case of using two or more carrier liquids as a mixture, for example, a mixture of a paraffin-based solvent and a vegetable oil, and a mixture of a silicone-based solvent and a vegetable oil are described, and a mixture of a paraffin-based solvent and a vegetable oil is preferable.

It is preferable that the carrier liquid used in the exemplary embodiments of the invention has paraffin oil as a main component. The term "main component" used herein refers to a component whose content is the highest among the components which consist the carrier liquid, and preferably a component whose content is equal to or higher than 50% by volume. Paraffin oil has high compatibility with the styrene based thermoplastic elastomer and the styrene based thermoplastic resin which are incorporated in the toner particles, and thus, when a carrier liquid having paraffin oil as a main component is used, the anti-scratching property (scratch resistance) is more certainly improved.

The carrier liquid may include an auxiliary additive such as a dispersant, an emulsifier, a surfactant, a stabilizer, a moistening agent, a thickener, a foaming agent, a defoaming agent, a coagulant, a gelling agent, a sedimentation inhibitor, a charge controlling agent, an antistatic agent, an aging inhibitor, a softener, a plasticizer, a filler, a fragrant substance, an adhesion inhibitor, a releasing agent or the like.

Method of Preparing Liquid Developer

In the preparation of a liquid developer of the exemplary embodiment of the invention, the toner particles and the carrier liquid described above, are mixed, and pulverized by using a disperser such as a ball mill, a sand mill, an attritor, a bead mill or the like, to obtain a liquid developer in which the toner particles are dispersed in the carrier liquid.

Moreover, the toner particles dispersion in the carrier liquid is not limited to the dispersion by using a dispersion machine, but may be attained by a method of dispersing particles by rotating special agitation blades at high speed, such as by a mixer; a method of dispersing particles by the shearing force of a rotor and stator, which is known as a homogenizer; a method of dispersing particles using ultrasonic waves; or the like.

A content of the toner particles in the carrier liquid is preferably 0.5% by weight to 40% by weight, and more preferably 1.0% by weight to 30% by weight from the viewpoints of adequate control of viscosity of the liquid developer and smooth circulation of the liquid developer in a development unit.

Thereafter, the obtained dispersion may be filtered by using, for example, a membrane filter having a pore diameter of 100 μm to filter out contaminants and coarse particles.

Process Cartridge, Image Forming Apparatus

An image forming apparatus of an exemplary embodiment of the invention includes an electrostatic latent image holding member (it may be referred as "photoreceptor" in some cases); a discharging device (unit) that discharges a surface of the electrostatic latent image holding member; an electrostatic latent image forming device (unit) that forms an electrostatic latent image on the surface of the electrostatic latent image holding member; a development device (unit) that stores a liquid developer of an exemplary embodiment of the invention, develops the electrostatic latent image formed on the surface of the electrostatic latent image holding member with the liquid developer, and thereby forms a toner image; a transfer device (unit) that transfers the toner image onto a recording medium; and a fixing device (unit) that fixes the toner image to the recording medium.

In the image forming apparatus, for example, the portion including the developing unit may have a cartridge structure (may be a process cartridge) which is attachable to and detachable from the main body of the image forming apparatus. As the process cartridge, a process cartridge equipped with a developing unit which stores the liquid developer described above and develops the electrostatic latent image formed on the latent image holding member by using the liquid developer to form a toner image, and is attachable to and detachable from the image forming apparatus is preferably used.

Hereinafter, an image forming apparatus using a liquid developer in an exemplary embodiment of the invention will be described with reference to drawings.

FIG. 1 is a schematic configuration diagram illustrating an example of an image forming apparatus according to an exemplary embodiment of the invention. The image forming apparatus 100 includes a photoreceptor (an electrostatic latent image holder) 10, a discharging device (a discharging unit) 20, an exposure device (an electrostatic latent image forming unit) 12, a development device (a developing unit) 14, an intermediate transfer member (a transfer unit) 16, a cleaner 18, and a transfer-fixing roller (a transfer unit) 28. The photoreceptor 10 has a cylindrical shape, and, on the outer circumference of the photoreceptor 10, the discharging device 20, the exposure device 12, the development device 14, the intermediate transfer member 16, and the cleaner 18 are provided.

Hereinafter, the operation of the image forming apparatus 100 will be briefly described.

The charging device 20 charges the surface of the photoreceptor 10 to have a predetermined potential and, based on image signals, the exposure device 12 exposes the charged surface by using, for example, a laser beam, thereby forming an electrostatic latent image.

The developing device 14 is configured to include a developing roller 14*a* and a developer storing container 14*b*. The developing roller 14*a* is provided in such a state that a part of the developing roller is dipped into the liquid developer 24 placed in the developer storing container 14*b*. The liquid developer 24 includes an insulating carrier liquid and toner particles containing a styrene based thermoplastic elastomer and a styrene based thermoplastic resin.

In the liquid developer 24, toner particles are dispersed. The positional variation in concentration of the toner particles in the liquid developer 24 may further be reduced by, for example, further providing a stirrer in the developer storage container 14*b* so as to keep stirring the liquid developer 24. Thus, the liquid developer 24 in which the variation in concentration of toner particles has been reduced may be supplied to the developing roller 14*a* which rotates in the direction of arrow A of figures.

The liquid developer 24 supplied to the developing roller 14*a* is then conveyed to the photoreceptor 10 while the amount of the liquid developer on the developing roller 14*a* is limited to a certain amount by a regulation device. Then, the liquid developer 24 is supplied onto the electrostatic latent image in a position where the developing roller 14*a* and the photoreceptor 10 come close to each other (or contact with each other). Thus, the electrostatic latent image may be developed to form a toner image 26.

The toner image 26 developed is then conveyed by the photoreceptor 10 which rotates in the direction of arrow B of figures, and is transferred to a sheet of paper (a recording medium) 30. In an exemplary embodiment of the invention, in order to increase transfer efficiency of the toner image to the recording medium, including detachment efficiency from the photoreceptor 10, and in order to perform fixation simultaneously with transferring to the recording medium, the toner image may be temporarily transferred to the intermediate transfer member 16 before the transfer to the sheet of paper 30. When the image is transferred, attainment of difference in circumferential velocity between the photoreceptor 10 and the intermediate transfer member 16 may be conducted if necessary.

Subsequently, the toner image which has been conveyed in the direction of arrow C by the intermediate transfer member 16, is transferred to and fixed on the sheet 30 at the contact area with the transfer-fixing roller 28.

The transfer-fixing roller 28 sandwiches the sheet 30 with the intermediate transfer member 16, so that the toner image on the intermediate transfer member 16 is adhered onto the sheet 30, whereby the toner image may be transferred to the sheet 30, and the toner image may be fixed on the sheet to form fixed image 29. The fixation of the toner image may be preferably performed by applying pressure and heat by using a transfer-fixing roller 28 equipped with a heating element. A fixing temperature is usually 120° C. or more but 200° C. or less.

When the intermediate transfer member 16 is a roller as shown in FIG. 1, it composes a roller pair with the transfer-fixing roller 28. Therefore, the intermediate transfer member 16 and the transfer-fixing roller 28 may serve as a fixing roller and a press roller respectively in a fixation device and provide fixing function. Namely, when the sheet 30 passes through the nip, the toner image is transferred, heated and pressed by the transfer-fixing roller 28 onto the intermediate transfer member 16, whereby the binder resin in the toner particles that form the toner image may be softened and thereby the toner image may be infiltrated into the fibers of the sheet 30 to form fixed image 29 onto the sheet 30.

It should be noted that the transfer and fixation to the sheet 30 are performed at the same time in the exemplary embodiment, but the transfer and fixation may be separately performed, and for example, the fixation may be performed after the transfer. In this case, a transfer roller to which a toner image is transferred from the photoreceptor 10 may have a function similar to that of the intermediate transfer member 16.

Further, the residual toner on the photoreceptor 10, which has transferred the toner image 26 to the intermediate transfer member 16, is conveyed to the contact position between the photoreceptor and a transfer residual toner particle cleaner 18, and is recovered by the cleaner 18. Note that, when the transfer efficiency is almost 100% and the residual toner is not problematic, it is not necessary to provide the cleaner 18.

The image forming apparatus 100 may further include a erasing device (not shown) that removes the charges from the surface of the photoreceptor 10 after transfer but before the next charging.

The charging device 20, the exposure device 12, the developing device 14, the intermediate transfer member 16, the transfer-fixing roller 28, and the cleaner 18 included in the image forming apparatus 100 all act synchronously with the rotating speed of the photoreceptor 10.

By forming an image on a recording medium 30, such as paper, by using the image forming apparatus 100 having such a configuration, an image having a high durability with respect to folding may be obtained.

EXAMPLES

Hereinafter, the present invention will be described further specifically with reference to Examples. However, the invention is not limited to these Examples. Hereinafter, unless otherwise specified, "part(s)" and "%" mean "part(s) by weight" and "% by weight", respectively.

<Preparation of Developer>

Example 1

40 parts by weight of a cyan pigment, C.I. Pigment Blue 15:3 (manufactured by Clariant Co., Ltd.) are added to 60 parts by weight of a styrene-acryl resin (trade name: FSR-051, manufactured by FUJIKURA KASEI Co., Ltd.; weight average molecular weight of 380,000), and the mixture is kneaded using a pressure kneader. The kneaded substance is roughly pulverized to prepare a cyan pigment master batch.

Next, a mixture having the following composition is dissolved and dispersed for 24 hours by using a ball mill.

The cyan pigment master batch described above: 25 parts by weight,

Styrene-acryl resin (trade name: FSR-053, manufactured by FUJIKURA KASEI Co., Ltd.; weight average molecular weight of 320,000; acid value of 10): 60 parts by weight, Styrene based thermoplastic elastomer (trade name: ASAPRENE T439, manufactured by Asahi Kasei Corporation; styrene-butadiene block copolymer): 10 parts by weight, Styrene based thermoplastic elastomer (trade name: TUFPRENE A, manufactured by Asahi Kasei Corporation; styrene-butadiene block copolymer): 5 parts by weight, and Ethyl acetate: 200 parts by weight.

Separately, 20 parts of calcium carbonate (trade name: LUMINUS, manufactured by MARUO CALCIUM CO., LTD.) as a dispersion stabilizer are added to an aqueous solution obtained by dissolving 20 parts of sodium chloride (manufactured by Wako Pure Chemical Industries, Ltd.) in 135 parts of ion exchanged water, and are dispersed for 24 hours using a ball mill to obtain a dispersion medium. Then, 100 parts of the above mixture are added to 170 parts of the dispersion medium, and are emulsified for 1 minutes using an emulsifier (trade name: HIGH-FLEX HOMOGENIZER ULTRA-TURRAX T-25, manufactured by IKA Corporation) at 8,000 rpm, and at 24,000 rpm, to obtain a suspension.

The suspension obtained as described above is placed in a separable flask equipped with a stirrer, a thermometer, a condenser, and a nitrogen inlet tube. While introducing nitrogen from the nitrogen inlet tube, the suspension is stirred at 60° C. for 3 hours, thereby removing ethyl acetate therefrom. Thereafter, the contents in the separable flask are cooled. Then, a 10% aqueous solution of hydrochloric acid is added to the reaction liquid to decompose the calcium carbonate, and then solid-liquid separation is performed by centrifugal separation.

The obtained particles are repeatedly washed three times with 1 L of ion exchanged water, and the resulting particles are dried under vacuum at 40° C.

A mixture of 35 parts by weight of dried cyan particles, 103 parts by weight of volatile paraffin oil (trade name: ISOPAR L, manufactured by Exxon Mobil Chemical Company), and 1.5 parts by weight of SOLSPERSE (trade name) is finely pulverized using a ball mill, to obtain a liquid developer 1 having an average particle diameter of 1.0 μm.

Example 2

40 parts by weight of a cyan pigment, C.I. Pigment Blue 15:3 (manufactured by Clariant Co., Ltd.) are added to 60 parts by weight of a styrene-acryl resin (trade name: FSR-051, manufactured by FUJIKURA KASEI Co., Ltd.; weight average molecular weight of 380,000), and the mixture is kneaded using a pressure kneader. The kneaded substance is roughly pulverized to prepare a cyan pigment master batch.

Next, a mixture having the following composition is kneaded using a pressure kneader.

The cyan pigment master batch described above: 25 parts by weight,

Styrene-acryl resin (trade name: FSR-053, manufactured by FUJIKURA KASEI Co., Ltd.; weight average molecular weight of 320,000; acid value of 10): 55 parts by weight, and Styrene based thermoplastic elastomer (trade name: SOE-L611X, manufactured by Asahi Kasei Corporation; hydrogenationed styrene-butadiene block copolymer): 20 parts by weight.

The kneaded product obtained above is pulverized using a jet mill, to obtain cyan particles having an average particle diameter of 10 μm.

A mixture of 35 parts by weight of cyan particles thus obtained above, 103 parts by weight of hardly volatile paraffin oil (trade name: MORESCO WHITE P 40, delivered from Matsumura Oil Co., Ltd.), and 1.5 parts by weight of SOLSPERSE (trade name) is finely pulverized using a ball mill, to obtain a liquid developer 2 having an average particle diameter of 1.1 μm.

Example 3

A liquid developer 102 is prepared in a manner substantially similar to that in Example 1 except that 45 parts by weight of the styrene-acryl resin (trade name: FSR-051, manufactured by FUJIKURA KASEI Co., Ltd.; weight average molecular weight of 380,000) instead of 60 parts by weight, and 25 parts by weight of the styrene based thermoplastic elastomer (trade name: ASAPRENE T439, manufactured by Asahi Kasei Corporation; styrene-butadiene block copolymer) instead of 10 parts by weight are used. A volume average particle diameter of the toner in the carrier liquid is 1.1 μm.

Example 4

A liquid developer 103 is prepared in a manner substantially similar to that in Example 1 except that 71 parts by weight of the styrene-acryl resin (trade name: FSR-051, manufactured by FUJIKURA KASEI Co., Ltd.; weight average molecular weight of 380,000) instead of 60 parts by weight, 4 parts by weight of the styrene based thermoplastic elastomer (trade name: ASAPRENE T439, manufactured by Asahi Kasei Corporation; styrene-butadiene block copolymer) instead of 10 parts by weight, and 0 parts by weight of the styrene based thermoplastic elastomer (trade name: TUFPRENE A, manufactured by Asahi Kasei Corporation; styrene-butadiene block copolymer) instead of 5 parts by weight, are used. A volume average particle diameter of the toner in the carrier liquid is 1.1 μm.

Example 5

A liquid developer 104 is prepared in a manner substantially similar to that in Example 2 except that the styrene based thermoplastic elastomer (trade name: SOE-L611X, manufactured by Asahi Kasei Corporation; hydrogenationed styrene-butadiene block copolymer) is replaced with a styrene-ethylene-butylene-styrene block copolymer based thermoplastic elastomer (trade name: TUFTEC M1911 (manufactured by Asahi Kasei Corporation, liquid absorptivity: 220%). A volume average particle diameter of the toner in the carrier liquid is 1.0 μm.

Example 6

A liquid developer 105 is prepared in a manner substantially similar to that in Example 2 except that the paraffin oil (trade name: MORESCO WHITE P 40, delivered from Matsumura Oil Co., Ltd.) is replaced with a naphthene-based oil (trade name: EXXOL D130, manufactured by Exxon Mobil Chemical Company). A volume average particle diameter of the toner in the carrier liquid is 1.0 μm.

Comparative Example 1

A liquid developer 101 is prepared in a manner substantially similar to that in Example 1 except that 15 parts by weight of styrene/acrylic resin (manufactured by FUJIKURA KASEI Co., Ltd.; styrene-butyl acrylate resin, weight average molecular weight of 320,000) is used instead of 15 parts by weight of the styrene based thermoplastic elastomer (10 parts by weight of ASAPRENE T439; trade name and 5 parts by weight of TUFPRENE A; trade name, all manufactured by Asahi Kasei Corporation). A volume average particle diameter of the toner in the carrier liquid is 1.0 μm.

Comparative Example 2

A liquid developer 106 is prepared in a manner substantially similar to that in Example 2 except that the styrene based thermoplastic elastomer (trade name: SOE-L611X, manufactured by Asahi Kasei Corporation is replaced with the acryl based thermoplastic elastomer (trade name: LA POLYMER, manufactured by Kuraray Co., Ltd.). A volume average particle diameter of the toner in the carrier liquid is 1.0 μm.

Comparative Example 3

A liquid developer 107 is prepared in a manner substantially similar to that in Example 1 except that an acryl based thermoplastic resin (trade name: MH-105-1, manufactured by FUJIKURA KASEI Co., Ltd.) is used instead of the styrene-acryl resin (trade name: FSR-051 and FSR-053, all manufactured by FUJIKURA KASEI Co., Ltd.). A volume average particle diameter of the toner in the carrier liquid is 1.0 μm.

Liquid absorptivity values at a temperature of 25° C. of thermoplastic elastomers used in Examples and Comparative Examples are listed in the following Table 1. A calculation procedure of the liquid absorptivity value is the same as described above.

TABLE 1

| Thermoplastic Elastomer | Liquid Absorptivity (%) at 25° C. |
|---|---|
| TUFPRENE A | 190 |
| SOE-L611X | 100 |
| ASAPRENE T439 | 150 |
| TUFTEC M1911 | 220 |
| LA Polymer | 5 |

EVALUATION

—Low-Temperature Fixing Property (MFT Evaluation)—

The liquid developers produced in Examples and Comparative Examples are each diluted with the same oil (trade name: MORESCO WHITE P-70) so as to give 2.5%, and the diluted liquid is introduced into a disposable cell (made of polystyrene). Two transparent electrodes arranged so as to face each other with a space of 1 mm are dipped into the diluted liquid, and a voltage of 300 V is applied for 30 seconds. Then, the electrodes are pulled out, and the toner accumulated on the plus electrode is transferred onto a sheet of J-COAT PAPER (trade name, manufactured by Fuji Xerox Co., Ltd.). The amount of the accumulated toner is measured, and it is revealed that the accumulated amount is 2 g/m$^2$. The transferred image is fixed using an external fixing device under a nip of 6 mm and a fixing speed of 500 mm/sec. In order to evaluate the minimum fixing temperature in the evaluation of fixation, the fixing device is modified such that the fixing temperature is variable. The fixing temperature of the fixing roll is raised stepwise every +5° C. from 100° C., and image fixation is performed. The 60° gloss is measured using MICRO-TRI-GLOSS (trade name, manufactured by BYK-Gardner), and the fixing temperature at which the image gloss exceeds 20 is designated as the minimum fixing temperature (MFT). The results are shown in Table 2. Note that, in this evaluation, when the MFT is 130° C. or lower, the low-temperature fixing property is evaluated as good.

—Durability with Respect to Folding—

Evaluation of durability with respect to folding is performed as follows. The sheet of paper is folded such that the inside has the image. The folded portion is slightly wiped, and then the degree of damage in the image is observed. The evaluation criteria are as follows.

AA: Peeling of image is scarcely observed.

A: Slight and discontinuous peeling of image is seen.

B: Discontinuous damage is observed.

C: Continuous damage is observed.

The results are shown in Table 2 below.

—Anti-Scratching Property—

Evaluation of anti-scratching property is performed using a scratch tester manufactured by LINAX CO., LTD., while applying a pressure of 0.5 kg. The evaluation criteria are as follows.

AA: Lowering of density scarcely occurs.

A: Lowering of density is seen; however the image remains.

B: A part of the image is peeled off.

The results are shown in Table 2 below.

TABLE 2

| | | Binder Resin (%) | | Kind of | Evaluation | | |
|---|---|---|---|---|---|---|---|
| | Developer No. | Thermoplastic Elastomer | Styrene-acryl | Liquid Carrier | MFT (° C.) | Fold | Scratch |
| Example 1 | 1 | 17 | 83 | Paraffin | 120 | A | A |
| Example 2 | 2 | 22 | 78 | Paraffin | 120 | AA | AA |
| Example 3 | 102 | 33 | 67 | Paraffin | 120 | A | B |
| Example 4 | 103 | 4 | 96 | Paraffin | 140 | B | A |
| Example 5 | 104 | 22 | 78 | Paraffin | 125 | A | B |
| Example 6 | 105 | 22 | 78 | Naphthene | 125 | A | B |
| Comparative Example 1 | 101 | 0 | 100 | Paraffin | 160 | C | A |
| Comparative Example 2 | 106 | 22 | 78 | Paraffin | 140 | C | A |
| Comparative Example 3 | 107 | 17 | 83 | Paraffin | 160 | C | B |

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A liquid developer comprising:

an insulating carrier liquid; and toner particles containing a binder resin, the binder resin containing a styrene-based thermoplastic elastomer and a styrene thermoplastic resin, and the toner particles being dispersed in the insulating carrier liquid, wherein the styrene thermoplastic resin contains a vinyl-based copolymer of a styrene based monomer and a (meth)acrylate monomer, the vinyl-based copolymer has a weight average molecular weight (Mw) in a range of 150,000 to 500,000 and the vinyl-based copolymer has a molecular weight distribution (Mw/Mn) of from 2 to 20.

2. The liquid developer according to claim 1, wherein a content of the styrene-based thermoplastic elastomer is approximately 5% by weight or more with respect to a total amount of the binder resin in the toner particle.

3. The liquid developer according to claim 1, wherein a liquid absorptivity value of the styrene-based thermoplastic elastomer at a temperature of 25° C. is approximately 200% by weight or less, the liquid being the insulating carrier liquid.

4. The liquid developer according to claim 1, wherein the styrene-based thermoplastic elastomer contains a block copolymer of styrene and olefin or a random copolymer of styrene and olefin.

5. The liquid developer according to claim 1, wherein the insulating carrier liquid contains paraffin oil as a main component.

6. The liquid developer according to claim 1, further comprising pigment particles.

7. The liquid developer according to claim 1, wherein the styrene-based thermoplastic elastomer contains a random copolymer of styrene and olefin.

8. The liquid developer according to claim 1, wherein the toner particles further comprise a wax.

* * * * *